US010424420B1

(12) United States Patent
Farkas et al.

(10) Patent No.: US 10,424,420 B1
(45) Date of Patent: Sep. 24, 2019

(54) DRAIN ALIGNED CABLE FOR NEXT GENERATION SPEEDS

(71) Applicant: DELL PRODUCTS, L.P., Round Rock, TX (US)

(72) Inventors: Sandor Farkas, Round Rock, TX (US); Bhyrav M. Mutnury, Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 16/044,242

(22) Filed: Jul. 24, 2018

(51) Int. Cl.

| | |
|---|---|
| ***H01B 7/08*** | (2006.01) |
| ***H01B 7/02*** | (2006.01) |
| ***H01B 11/00*** | (2006.01) |
| ***H01B 13/06*** | (2006.01) |
| ***H01B 13/00*** | (2006.01) |

(52) U.S. Cl.
CPC ..... *H01B 7/0823* (2013.01); *H01B 7/02* (2013.01); *H01B 7/0861* (2013.01); *H01B 11/002* (2013.01); *H01B 13/0036* (2013.01); *H01B 13/06* (2013.01)

(58) Field of Classification Search
CPC ..... H01B 7/0823; H01B 7/02; H01B 7/0861; H01B 11/002; H01B 13/0036; H01B 13/06
USPC ..... 174/72 A
See application file for complete search history.

(56) References Cited

U.S. PATENT DOCUMENTS

| | | | | |
|---|---|---|---|---|
| 7,790,981 | B2 | 9/2010 | Vaupotic et al. | |
| 9,159,470 | B2 | 10/2015 | Mutnury et al. | |
| 9,589,701 | B2 | 3/2017 | Mutnury et al. | |
| 9,625,974 | B2 * | 4/2017 | Bailey | G06F 1/3234 |
| 9,847,154 | B2 | 12/2017 | Grant et al. | |
| 2012/0073857 | A1 * | 3/2012 | Kelly | H01B 7/0823 174/110 R |
| 2015/0357082 | A1 * | 12/2015 | Mutnury | H01B 7/17 174/108 |
| 2016/0036112 | A1 * | 2/2016 | Sugiyama | H01B 7/0823 333/12 |
| 2017/0250009 | A1 | 8/2017 | Koeppendoerfer | |
| 2017/0256333 | A1 * | 9/2017 | Gundel | H01B 7/0838 |

* cited by examiner

*Primary Examiner* — Timothy J Thompson
*Assistant Examiner* — Charles Pizzuto
(74) *Attorney, Agent, or Firm* — Isidore PLLC

(57) ABSTRACT

A dual axial cable is provided with adjacent and substantially parallel first and second wires. Each wire is formed from electrical conductor surrounded by a respective first and second electrical insulator having lengthwise drain alignment groove on outward side and having respective first and second inward sides of interlocking structure. First and second inward sides of interlocking structure of first and second electrical insulators mutually engage to prevent relative transverse displacement of first and second wires. The interlocking structure maintains the planar alignment of lengthwise drain alignment grooves and electrical conductors of first and second wires. First and second drain conductors are received respectively in lengthwise drain alignment grooves of first and second electrical insulators and run adjacent and substantially parallel to first and second electrical conductors. Drain conductors are maintained in parallel alignment to electrical conductors to provide shielding benefits.

18 Claims, 10 Drawing Sheets

DRAIN ALIGNED CABLE FOR NEXT GENERATION SPEEDS

BACKGROUND

1. Technical Field

The present disclosure relates in general to communication cables in an information handling system (IHS), and more particularly to dual drain, dual axial communication cables in an IHS.

2. Description of the Related Art

As the value and use of information continue to increase, individuals and businesses seek additional ways to process and store information. One option available to users is information handling systems (IHSs). An IHS generally processes, compiles, stores, and/or communicates information or data for business, personal, or other purposes, thereby allowing users to take advantage of the value of the information. Because technology and information handling needs and requirements vary between different users or applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

In many applications, one or multiple IHSs configured as servers may be installed within a single chassis, housing, enclosure, or rack. Communication between components internal to the servers, as well as communication between two or more servers and/or between enclosures, are often accomplished via communication cables. Within a server, for example, cables can electronically connect one of more printed circuit boards (PCBs). Cables provide a lower loss mode for signal propagation compared to PCBs which makes cables a frequent design choice. Thus, communication cables are an integral part of conventional server design.

Generally-known single drain and dual drain dual-axial cables are satisfactory to support current signal/data transfer speeds within a conventional IHS. However, the signal/data speeds within newer generations of IHS are increasing significantly (e.g., doubling with each generation). Higher signal speeds result in a corresponding increase in signal integrity sensitivity to parasitic effects. With fifteenth generation (15G), Peripheral Component Interconnect Express (PCIe) is going to speeds of 16 Gbps (gigabits per second). Sixteenth generation (16G) can be expected to be at 32 Gbps speeds. Subtle effects that did not impact the signal performance of conventionally utilized dual axial cables become significant at next generation signal speeds.

BRIEF SUMMARY

In accordance with the teachings of the present disclosure, a dual axial cable includes adjacent and substantially parallel first and second wires. Each wire is formed from an electrical conductor surrounded by a respective first and second electrical insulator. Each electrical insulator is formed with a lengthwise drain alignment groove on an outward side and respective first and second inward sides of an interlocking structure. The first and second inward sides of the interlocking structure of corresponding first and second electrical insulators mutually engage to prevent a relative transverse displacement of the first and second wires. The interlocking structure maintains planar alignment of the lengthwise drain alignment grooves and electrical conductors of the first and second wires. First and second drain conductors are received respectively in the lengthwise drain alignment grooves of the respective first and second electrical insulators and run adjacent and substantially parallel to the first and second electrical conductors.

In accordance with the teachings of the present disclosure, an information handling system (IHS) includes a communication interconnect comprising a dual axial cable that is attached between first and second functional components. The dual axial cable includes adjacent and substantially parallel first and second wires. Each wire is formed from an electrical conductor that is surrounded by a respective first or second electrical insulator. Each electrical insulator has a lengthwise drain alignment groove on an outward side and has one of a first and second inward sides of an interlocking structure. The first and second inward sides of the interlocking structure of the first and second electrical insulators mutually engage to prevent a relative transverse displacement of the first and second wires. The interlocking structure maintains planar alignment of the lengthwise drain alignment grooves and electrical conductors of the first and second wires. First and second drain conductors are received respectively in the lengthwise drain alignment grooves of the first and second electrical insulators. The first and second drain conductors run adjacent and substantially parallel to the first and second electrical conductors.

In accordance with the teachings of the present disclosure, a method includes forming first and second wires respectively by surrounding a length of an electrical conductor with a respective one of a first and second electrical insulator. Each insulator is formed having a lengthwise drain alignment groove on an outward side and having one side of first and second inward sides of an interlocking structure. The method includes mutually engaging the first and second inward sides of the interlocking structure of the first and second electrical insulators to prevent a relative transverse displacement of the first and second wires. Engaging the interlocking mechanism maintains planar alignment of the lengthwise drain alignment grooves and electrical conductors of the first and second wires. The first and second wires are adjacent and substantially parallel to each other. The method includes inserting first and second drain conductors respectively in the lengthwise drain alignment grooves of the first and second electrical insulators. The first and second drain conductors run adjacent and substantially parallel to the first and second electrical conductors, respectively, forming a dual axial cable.

The above presents a general summary of several aspects of the disclosure in order to provide a basic understanding of at least some aspects of the disclosure. The above summary contains simplifications, generalizations and omissions of detail and is not intended as a comprehensive description of the claimed subject matter but, rather, is intended to provide a brief overview of some of the functionality associated therewith. The summary is not intended to delineate the scope of the claims, and the summary merely presents some concepts of the disclosure in a general form as a prelude to the more detailed description that follows. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1A:
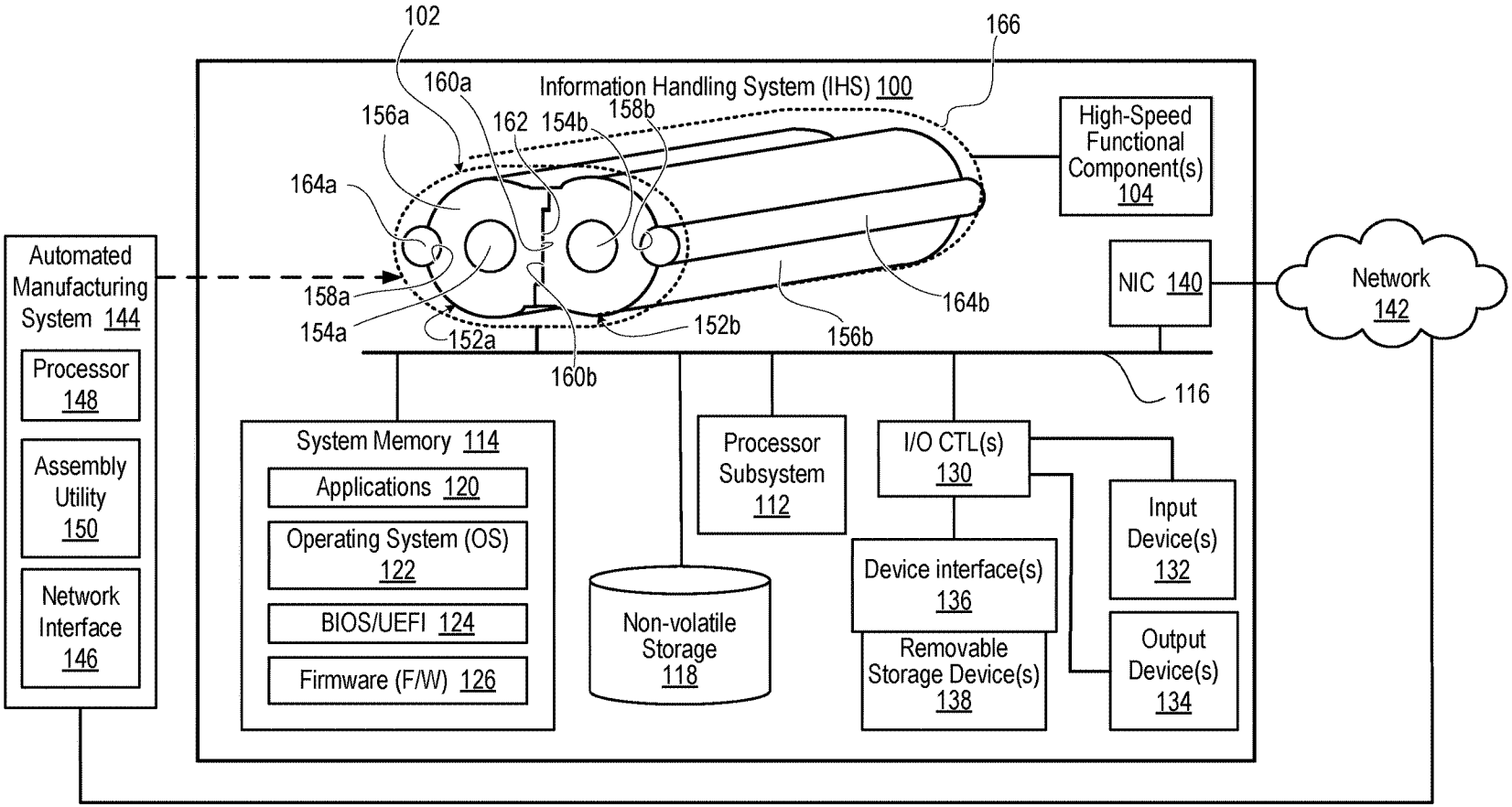
FIG. 1A is a block diagram representation illustrating an example information handling system (IHS) having a dual drain cable, according to one or more embodiments.

According to aspects of the present disclosure, a dual axial cable, an information handling system (IHS), and a method provide for differential signal communication having electrical performance capable of next generation speeds. The dual axial cable includes adjacent and substantially parallel first and second wires. Each wire is formed from an electrical conductor surrounded by a respective first and second electrical insulator having a lengthwise drain alignment groove on an outward side and having one side of respective first and second inward sides of an interlocking structure. The first and second inward sides of the interlocking structure mutually engage to prevent a relative transverse displacement of the first and second wires. The interlocking structure maintains planar alignment of the lengthwise drain alignment grooves and of the electrical conductors of the first and second wires. First and second drain conductors are received respectively in the lengthwise drain alignment grooves of the first and second electrical insulators and respectively run adjacent and substantially parallel to the first and second electrical conductors.

The drain alignment grooves provide a mechanism to lock the drain conductor or wire in position by creating a small groove or ridge in dielectric insulation medium of the first and second electrical insulators around the electrical conductors. By creating the groove with a depth of approximately half of the diameter of the drain conductor, the drain conductor is locked in position and will not move during the cable manufacturing and assembly and subsequent usage. The drain alignment groove can be created during an extrusion process, ensuring consistent positioning of drain wire relative to the conductor in order to achieve optimized electrical characteristics. The amount of electrical current carried by the drain conductor is small and can be served by a small diameter wire. Generally-known drain wires are physically larger than electrically necessary in order to be assembled into a cable assembly. The physical support to the drain conductors provided by the present innovation allows the diameter of the drain conductors to be reduced. Moreover, the drain wire size can be reduced to a fraction of the conventional size, such as a half or two thirds size reduction, without impact to the electrical performance. The drain alignment groove has dimensions that are scaled proportionately to receive and secure the reduced size drain conductor. The interlocking structure further aligns the electrical conductors with the drain conductors to optimize the dual drain cable. The two wires become a single assembly, maintaining alignment of the electrical conductors with the drain alignment grooves providing alignment for the drain wires.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

FIG. 1A illustrates a block diagram representation of example information handling system (IHS) 100 having dual drain cable 102 with mechanical and electrical dual-axial properties that support next generation (and beyond) differential signaling speeds to high-speed functional component(s) 104. Within the general context of IHSs, IHS 100 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, IHS may be personal computer, personal digital assistant (PDA), consumer electronic device, network storage device, or any other suitable device and may vary in size, shape, performance, functionality, and price. IHS 100 may include random access memory (RAM), one or more processing resources such as central processing unit (CPU) or hardware or software control logic, ROM, and/or other types of nonvolatile memory. Additional components of IHS may include one or more disk drives, one or more network ports for communicating with external devices as well as various input and output (I/O) devices, such as keyboard, mouse, and video display. IHS 100 may also include one or more buses operable to transmit communications between various hardware components.

Referring again to FIG. 1A, IHS 100 has processor subsystem 112 that is coupled to system memory 114 via system interconnect 116, which includes dual drain cable 102. System interconnect 116 can be interchangeably referred to as system bus, in one or more embodiments. Also coupled to system interconnect 116 is non-volatile storage, e.g., non-volatile random-access memory (NVRAM) storage 118, within which can be stored one or more software and/or firmware modules and one or more sets of data that can be utilized during operations of IHS 100. These one or more software and/or firmware modules can be loaded into system memory 114 during operation of IHS 100. Specifically, in one embodiment, system memory 114 can include therein a plurality of such modules, including one or more of application(s) 120, operating system (OS) 122, basic input/output system (BIOS) or Uniform Extensible Firmware Interface (UEFI) 124, and firmware (F/W) 126. These software and/or firmware modules have varying functionality when their corresponding program code is executed by processor subsystem 112 or secondary processing devices within IHS 100. For example, application(s) 120 may include a word processing application, presentation application, and management station application, among other applications.

IHS 100 further includes one or more input/output (I/O) controllers 130, which support connections by and processing of signals from one or more connected input device/s 132, such as keyboard, mouse, touch screen, or microphone. I/O controllers 130 also support connection to and forwarding of output signals to one or more connected output devices 134, such as monitor or display device or audio speaker(s). Additionally, in one or more embodiments, one or more device interfaces 136, such as optical reader, universal serial bus (USB), card reader, Personal Computer Memory Card International Association (PCMCIA) slot, and/or high-definition multimedia interface (HDMI), can be associated with IHS 100. Device interface(s) 136 can be utilized to enable data to be read from or stored to corresponding removable storage device(s) 138, such as compact disk (CD), digital video disk (DVD), flash drive, or flash memory card. In one or more embodiments, device interface(s) 136 can further include general purpose I/O interfaces such as inter-integrated circuit ($I^2C$), system management bus (SMB), and peripheral component interconnect (PCI) buses.

IHS 100 comprises network interface controller (NIC) 140. NIC 140 enables IHS 100 and/or components within IHS 100 to communicate and/or interface with other devices, services, and components that are located external to IHS 100. These devices, services, and components can interface with IHS 100 via external network, such as example network 142, using one or more communication protocols that can include transport control protocol/internet protocol (TCP/IP) and network block device (NBD) protocol. Network 142 can be local area network, wide area network, personal area network, and the like, and connection to and/or between network 142 and IHS 100 can be wired, wireless, or a combination thereof. For purposes of discussion, network 142 is indicated as single collective component connected to automated manufacturing system 144 that communicates via network interface 146.

Automated manufacturing system 144 controls fabrication and assembly of dual drain cable 102. Processor 148 executes assembly utility 150 to make dual drain cable 102 that includes adjacent and substantially parallel first and second wires 152*a-b*. Each wire 152*a-b* is formed with electrical conductor 154*a-b* surrounded by respective first and second electrical insulator 156*a-b* having lengthwise drain alignment groove 158*a-b* on outward side and having respective first and second inward sides 160*a-b* of interlocking structure 162. First and second inward sides 160*a-b* of interlocking structure 162 of first and second electrical insulators 156*a-b* mutually engage to prevent relative transverse displacement of first and second wires 152*a-b*. Interlocking structure 162 maintains planar alignment of lengthwise drain alignment grooves 158*a-b* and electrical conductors 154*a-b* of first and second wires 152*a-b*. First and second drain conductors 164*a-b* are received respectively in lengthwise drain alignment grooves 158*a-b* of first and second electrical insulators 156*a-b* and run adjacent and substantially parallel to first and second electrical conductors 152*a-b*. A shield 166 of foil conductive material is helically wrapped around exterior perimeter of the assembly of first and second wires 152*a-b* and first and second drain conductors 164*a-b*.

Dual drain cable 102 can be used for short to medium reach (e.g., less than 10-20 meters) in standards, including, but not limited to, Serial Attached Small Computer System Interface (SAS), InfiniBand, Serial Advanced Technology Attachment (SATA), Peripheral Component Interconnect Express (PCIe), Double Speed Fibre Channel, Synchronous Optical Networking (SONET), Synchronous Digital Hierarchy (SDH), and 10 Gigabit Ethernet (10 GbE). The present disclosure provides an approach to constructing dual axial cables that ensure that the electrical performance is not compromised by displacement of drain conductors 164*a-b*. Maintaining electrical performance allows expected higher communication speeds for use in PCIe fifth generation (Gens) and SAS 4.0 solutions in sixteenth generation (16G) and beyond.

Figure 1B:
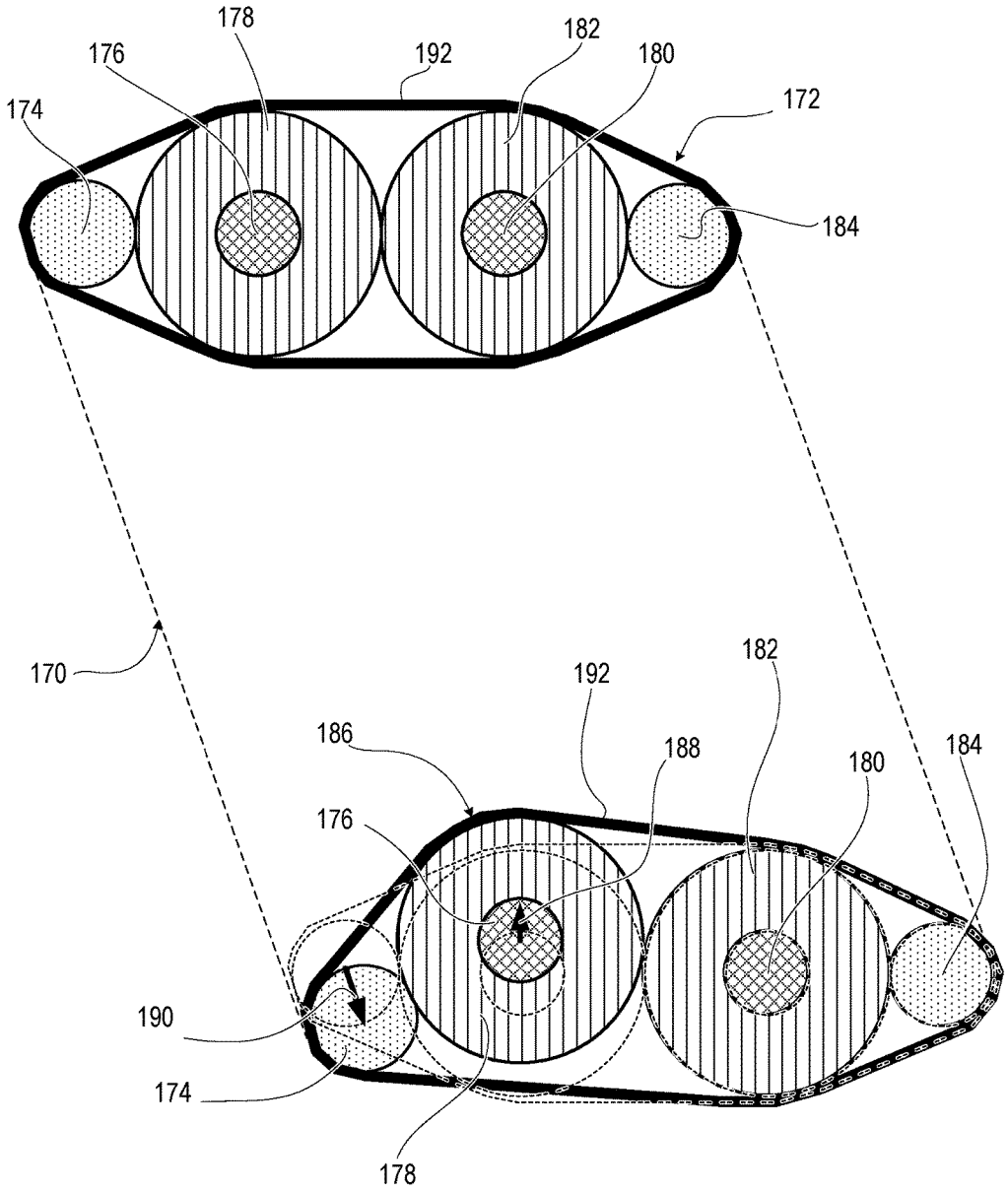
FIG. 1B (prior art)
FIG. 1B is a cross-sectional view of two ends of a generally-known dual axial cable.

FIG. 1B illustrates a generally-known dual-axial cable 170 having first end 172 that is ideally manufactured with left drain conductor 174, left signal conductor 176 of left differential signal wire 178, right signal conductor 180 of right signal wire 182, and right drain conductor 184 all in planar alignment. Each of left and right drain conductors 174, 184 and left and right signal wires 178, 182 have a respective circular cross section that contact only at a small areas. Thus, left and right drain conductors 174, 184 and left and right signal wires 178, 182 can twist or otherwise move relative to each other during assembly at a second end 186 of generally-known dual-axial cable 170. At second end 186, left signal wire 178 includes a relative transverse displacement 188 upward from right signal wire 182, creating a nonplanar alignment with the combination of right signal wire 182 and right drain conductor 184. In response to the relative transverse displacement 188, left drain wire 174 has a relative displacement 190 downward and to the right. Relative displacement 190 takes left drain wire 174 out of planar alignment with any combination of left and right signal wires 178, 182 and right drain conductor 184. For example, an outer layer 192 that provides electrical shielding and protection to the dual-axial cable 170 can urge the left drain conductor 174 with relative displacement 190. Electrical performance is degraded when left drain conductor 174, left signal conductor 176, right signal conductor 180, and right drain conductor 184 are not all in planar alignment.

Figure 2:
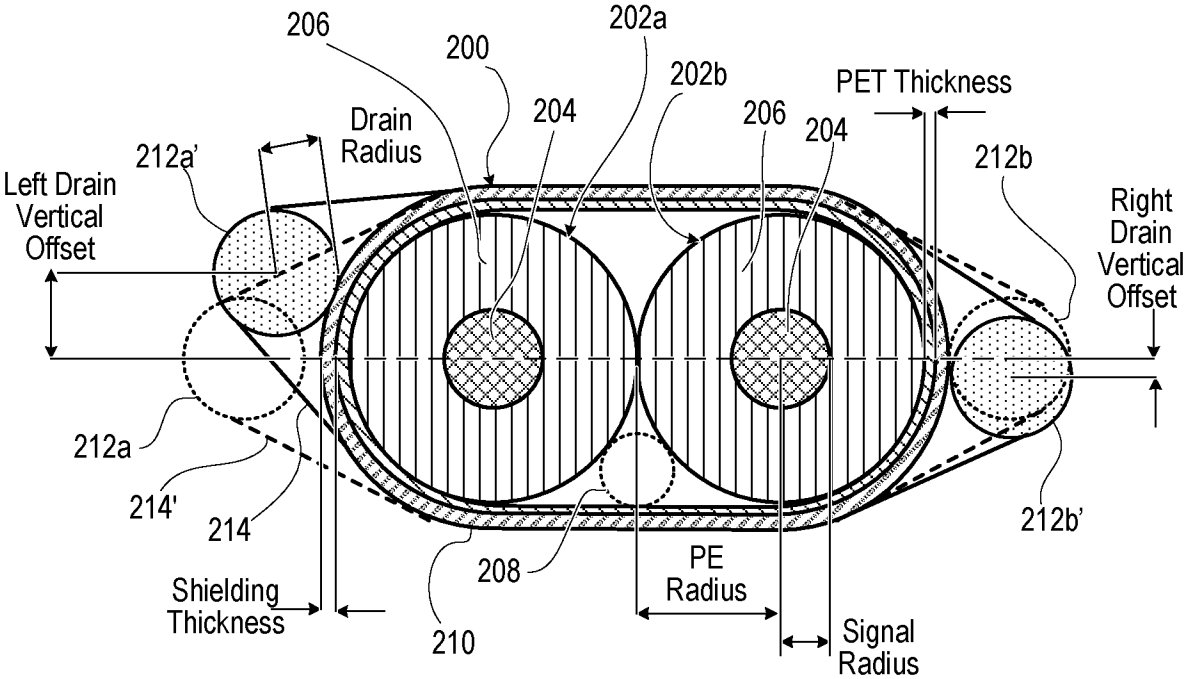
FIG. 2 (prior art)
FIG. 2 is a cross-sectional view of generally-known dual axial cable.

The present disclosure recognizes how conventional dual-axial cables can be improved. FIG. 2 illustrates a cross-sectional view of conventional dual axial cable 200 having wires 202*a-b* each including central conductor wire 204 surrounded by cylindrical insulator 206. In one embodiment, central drain wire 208 (shown in dashed line) represents one known approach to improve shielding when assembled within spiral wrap shield 210 as a central drain dual-axial cable. However, center drain dual-axial cables have a resonance or suck-out effect due to the spiral wrapping of the shield 210 around the assembly of two conductor wires 202*a-b* and central drain wire 208. The spiral wrap shield 210 creates a periodic return path discontinuity resulting in a resonance, which degrades performance, as described below with regard to FIG. 3.

Dual-drain dual-axial cables, represented by aligned drain wires 212*a-b* (shown in dashed lines) and without central drain wire 208, do not have resonance and thus support very high speeds and long lengths. Helical foil wrap 214 has been properly applied during manufacturing. A polyester (e.g., polyethylene terephthalate (PET)) sheath (not shown) covers the entire assembly. However, dual drain dual-axial cables also have a problem which can cause performance issues at high speeds. The location of the two drain wires 212*a-b* can be off-set by a few mils, depending on the spiral wrapping and depending on the cable formation, such as due helical foil wrap 214' (shown in dashed lines). For example, left drain wire 212*a'* is upwardly off-set and right drain wire 212*b'* is downwardly offset from the ideal positions of left and right drain wires 212*a-b*.

Figure 3:
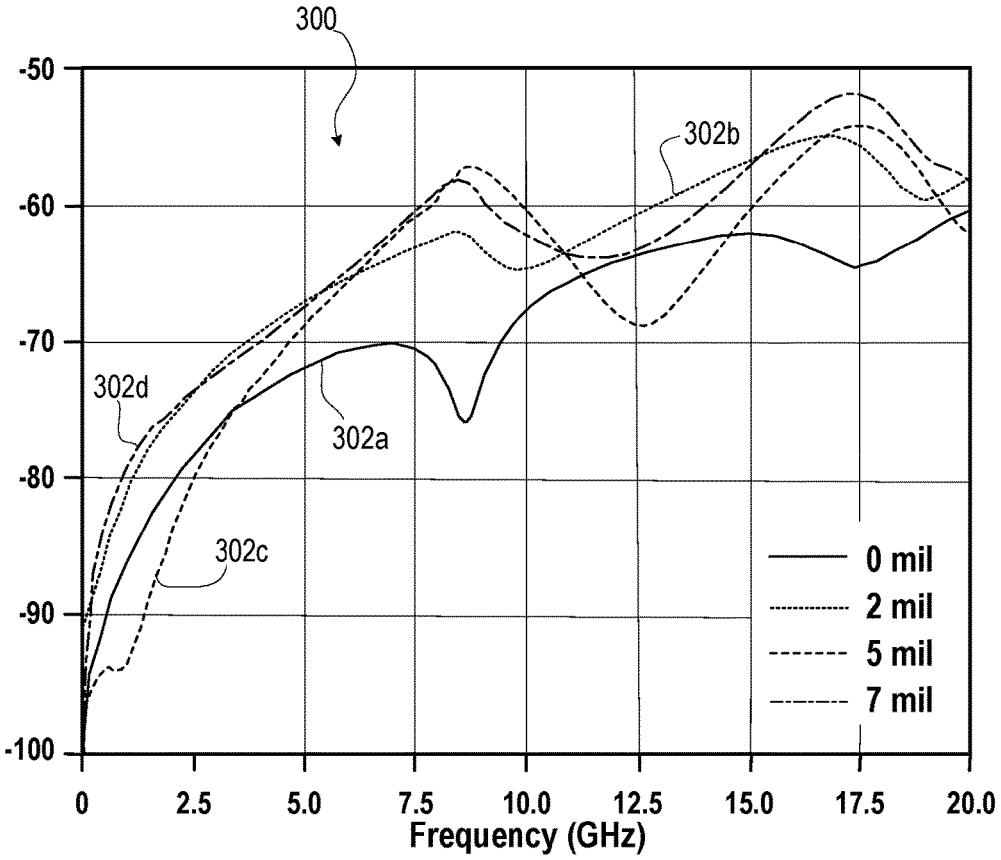
FIG. 3 (prior art)
FIG. 3 is a graphical representation illustrating frequency versus impedance plots for a generally-known dual drain, dual-axial cable.

FIG. 3 is a graphical representation 300 of frequency versus impedance plots 302*a-d* that illustrate impedance changes that result from an offset between drain wires for a conventional dual drain, dual-axial cable. A plot 302*a* for an aligned drain wire ("0 mil) generally has lower impedance than impedance plots 302*b-d* respectively for drain wires with 2, 5 and 7 mils of offset. Lower impedance is related to propagation delay and mode conversion impacts. Any mismatch in propagation delay results in resonance at high speeds. Mismatch in propagation delay also results in common-mode conversion from differential mode which increases crosstalk. Conventional dual drain, dual-axial cables can have degraded performance represented by 302*b-d* in addition to a subset that are manufactured with 0 mil offset as given by impedance plot 302*a*. The conventional dual drain, dual-axial cable does not maintain a uniform performance across lengths of cable or between certain specimens. Thus, the conventional dual drain, dual axial cable is inadequate for higher communication speed requirements. By contrast, a dual-drain cable manufactured according to aspects of the present innovation avoids having non-zero offsets from the ideal. Instead, all drain wires uniformly have an ideal 0 mil offset as given by impedance plot 302*a*. Without any drain wires in a manufacturing sample that deviate with non-zero offsets such as impedance plots 302*b-d*, a dual-drain cable according to the present disclosure is adequate for higher communication speed requirements. Dual-drain cables that maintain drain wires with ideal 0 mil offsets is a significant improvement over conventional dual drain, dual-axial cables.

Figure 4A:
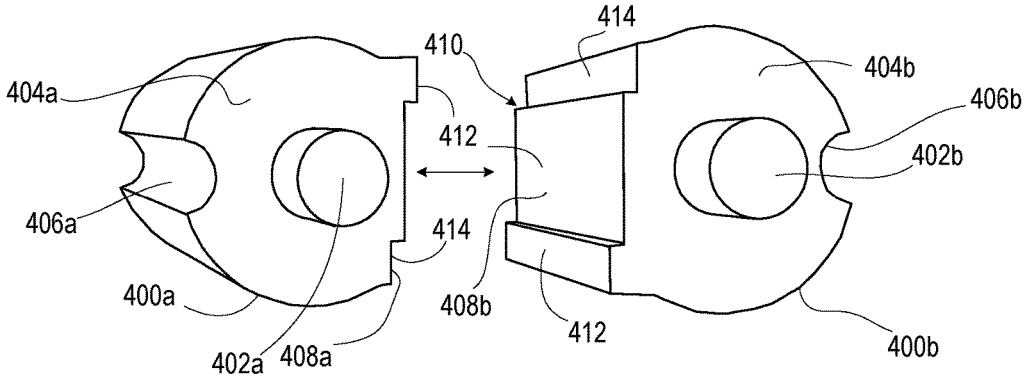
FIG. 4A is a left side perspective view illustrating example first and second wires that are disassembled and identically formed, according to one or more embodiments.
Figure 4B:
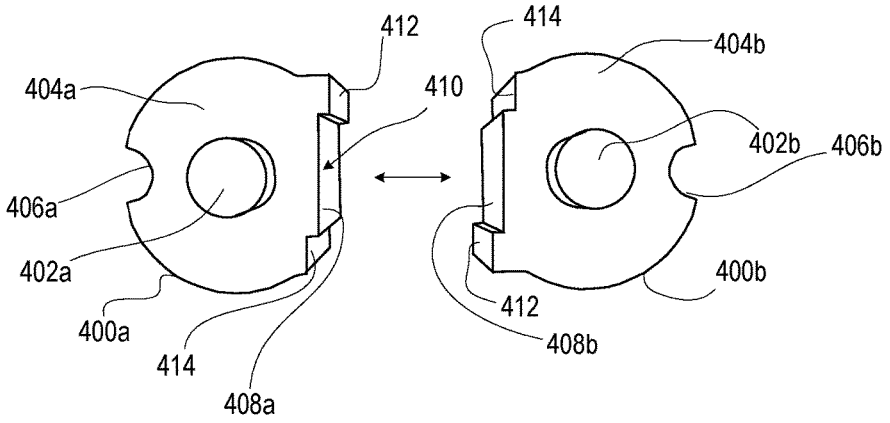
FIG. 4B is a center perspective view illustrating the example first and second wires disassembled, according to one or more embodiments.

FIGS. 4A-4B are perspective views of example first and second wires 400*a-b* that are identically formed with an electrical conductor 402*a-b* surrounded by a respective first and second electrical insulators 404*a-b*. First and second electrical insulators 404*a-b* each has lengthwise drain alignment groove 406*a-b* on an outward side. First and second electrical insulators 404*a-b* have respective first and second inward sides 408*a-b* of interlocking structure 410. Second wire 400*b* is rotated 180° about a longitudinal axis relative to the first wire 400*a* to orient the second inward side 408*b* into contacting opposition with the first inward side 408*a*. First and second inward sides 408*a-b* include male and female interlocking surfaces 412, 414 symmetrically spaced about a midpoint.

Figure 4C:
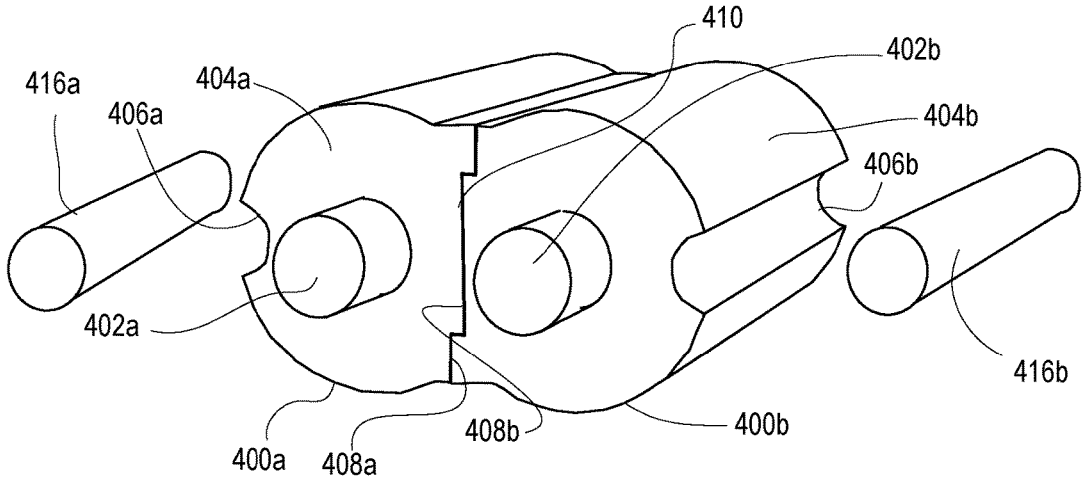
FIG. 4C is a right-side perspective view illustrating the example first and second wires interlocked and with disassembled drain conductors, according to one or more embodiments.
Figure 4D:
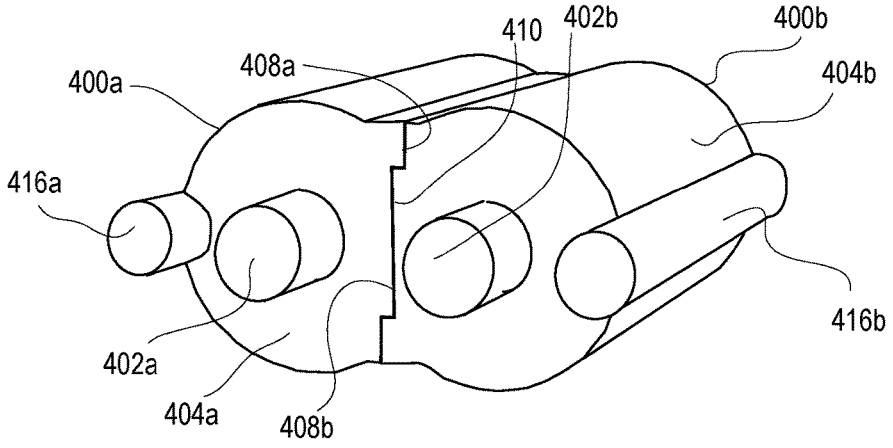
FIG. 4D is a right-side perspective view illustrating the example first and second wires assembled with the drain conductors, according to one or more embodiments.

FIGS. 4C-4D are perspective views of assembled first and second wires 400*a-b*. First and second inward sides 408*a-b* of the interlocking structure 410 of the first and second electrical insulators 404*a-b* mutually engage to prevent a relative transverse displacement of the first and second wires 400*a-b*. Thus, interlocking structure 410 maintains planar alignment of the lengthwise drain alignment grooves 406*a-b* and electrical conductors 402*a-b* of the first and second wires 400*a-b*. FIG. 4C illustrates first and second drain conductors 416*a-b* disassembled from the first and second wires 400*a-b*. FIG. 4D illustrates first and second drain conductors 416*a-b* adjacent and substantially parallel to first and second wires 400*a-b* and received in respective drain alignment grooves 406*a-b*.

In the construction illustrated by FIG. 4D, while some return current may flow on shield (166, FIG. 1A), the largest portion of such return current may flow through dual drain conductors 416*a-b*. The current through dual drain conductors 416*a-b* thus avoids the periodic impedance discontinuity of the shield (166, FIG. 1A), and thereby reduces the occurrence of undesired resonance. Unlike generally-known dual-drain cables, the cable size (e.g., width) is not appreciably increased. Generally-known dual-drain cables have a width that is directly increased by the diameter of the two drain wires. By contrast, first and second wires 400*a-b* increase about half as much by fitting about half of the diameter of first and second drain conductors 416*a-b* within respective first and second wires 400*a-b*. The grooves provide physical support to first and second drain conductors

416*a-b* allowing sizing of the drain conductors 416*a-b* according to an amount of required electrical conductivity. Thus supported, the diameter of the first and second drain conductors 416*a-b* can be reduced by at least half, enabling use in applications that require smaller width cables.

Figure 5A:
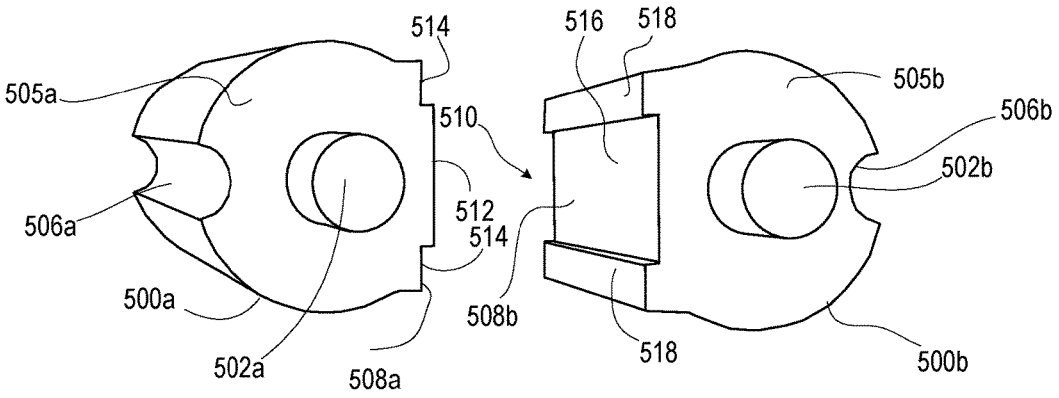
FIG. 5A is a left side perspective view illustrating example first and second wires that are disassembled and complementarily formed, according to one or more embodiments.
Figure 5B:
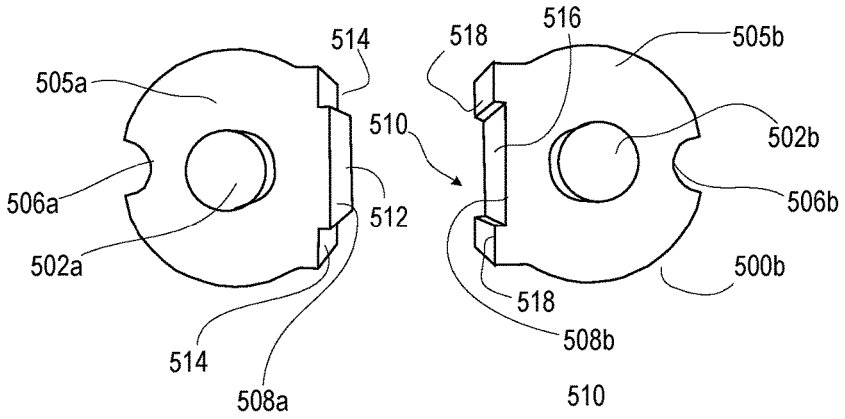
FIG. 5B is a center perspective view illustrating the example first and second wires disassembled, according to one or more embodiments.

FIGS. 5A-5B are perspective views of example first and second wires 500*a-b* that are correspondingly formed with an electrical conductor 502*a-b* surrounded by respective first and second electrical insulators 505*a-b*. First and second electrical insulators 505*a-b* have lengthwise drain alignment groove 506*a-b* on an outward side. First and second electrical insulators 505*a-b* have respective first and second inward sides 508*a-b* of interlocking structure 510. First inward side 508*a* includes a central male interlocking surface 512 between two female interlocking surfaces 514. Second inward side 508*b* includes a central female interlocking surface 516 between two male interlocking surfaces 518.

Figure 5C:
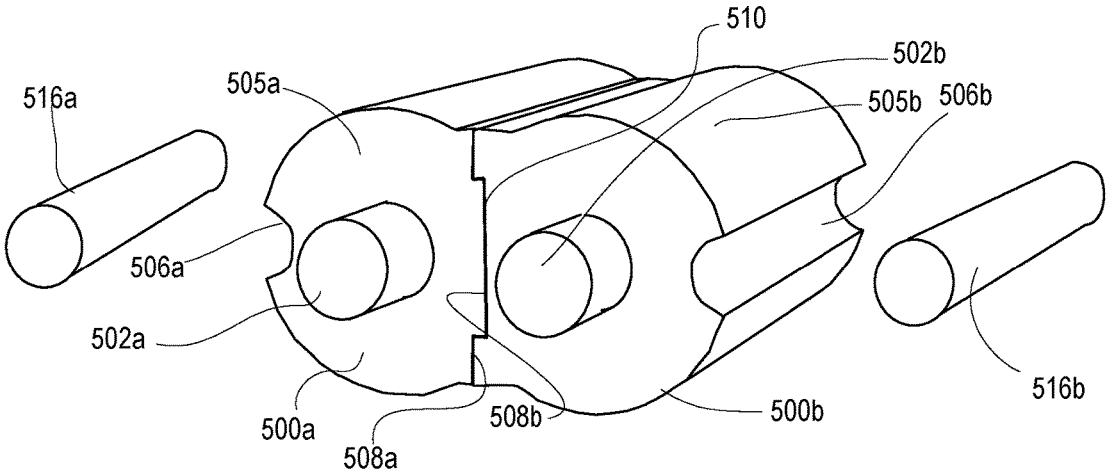
FIG. 5C is a right-side perspective view illustrating the example first and second wires interlocked and with disassembled drain conductors, according to one or more embodiments.
Figure 5D:
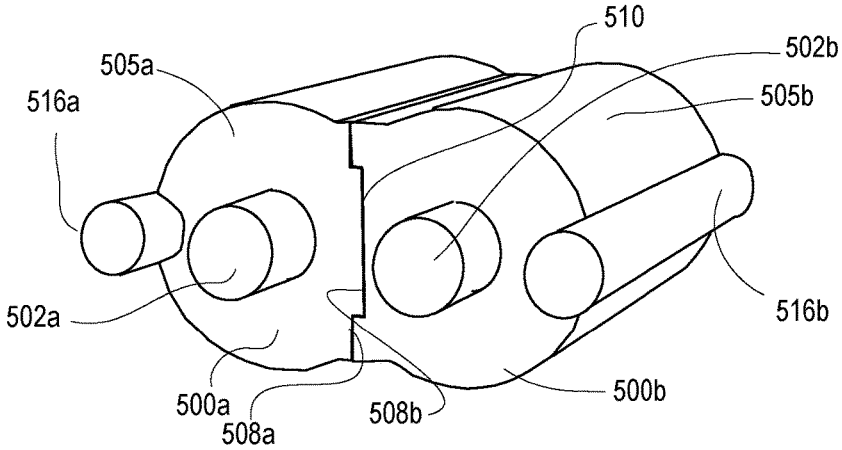
FIG. 5D is a right-side perspective view illustrating the example first and second wires that are assembled with the drain conductors, according to one or more embodiments.

FIGS. 5C-5D are perspective views of assembled first and second wires 500*a-b*. First and second inward sides 508*a-b* of interlocking structure 510 of the first and second electrical insulators 504*a-b* mutually engage to prevent a relative transverse displacement of the first and second wires 500*a-b*. Thus, interlocking structure 510 maintains planar alignment of the lengthwise drain alignment grooves 506*a-b* and electrical conductors 502*a-b* of first and second wires 500*a-b*. FIG. 5C illustrates first and second drain conductors 516*a-b* disassembled from the first and second wires 500*a-b*. FIG. 5D illustrates first and second drain conductors 516*a-b* that are adjacent and substantially parallel to first and second wires 500*a-b* and received in respective drain alignment grooves 506*a-b*.

Figure 6:
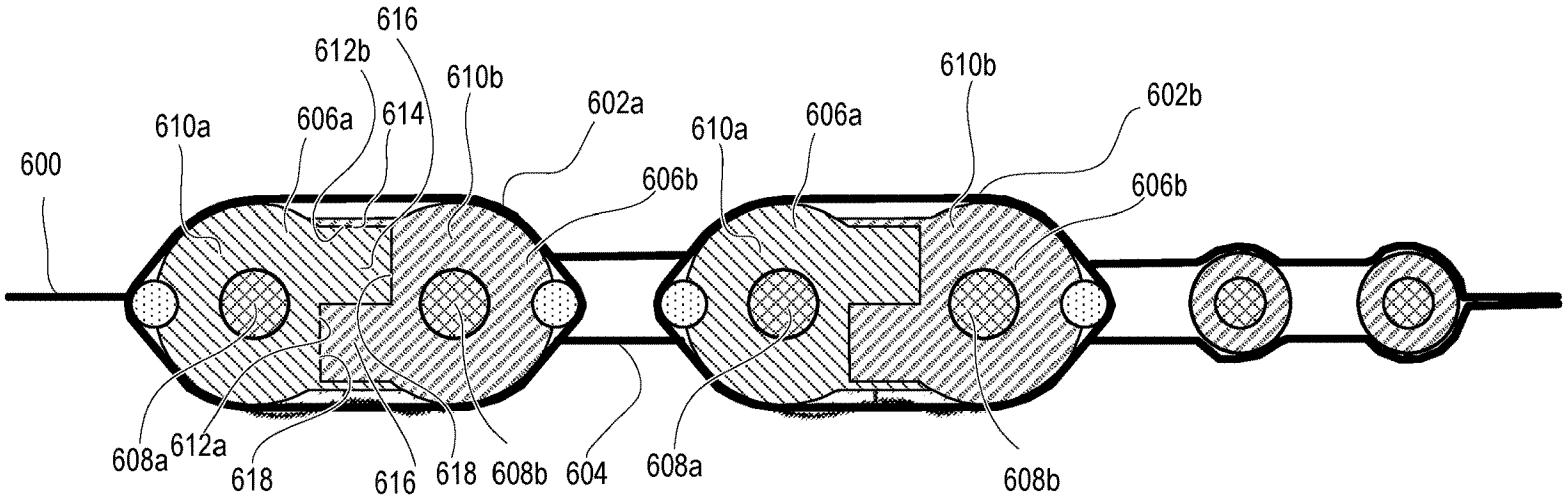
FIG. 6 is a cross-section view illustrating a ribbon cable formed from two dual drain cables attached in parallel alignment by a ribbon substrate, according to one or more embodiments.

FIG. 6 is a cross-section view of a ribbon cable 600 formed from two dual drain cables 602*a-b* attached in parallel alignment by a ribbon substrate 604. Each dual drain cable 602*a-b* includes example first and second wires 606*a-b* that are correspondingly formed with an electrical conductor 608*a-b* surrounded by a respective first and second electrical insulator 610*a-b*. First and second electrical insulators 610*a-b* have respective first and second inward sides 612*a-b* of interlocking structure 614 that include correspondingly sized male and female interlocking surface 616, 618 on respective sides about a midpoint.

Figure 7:
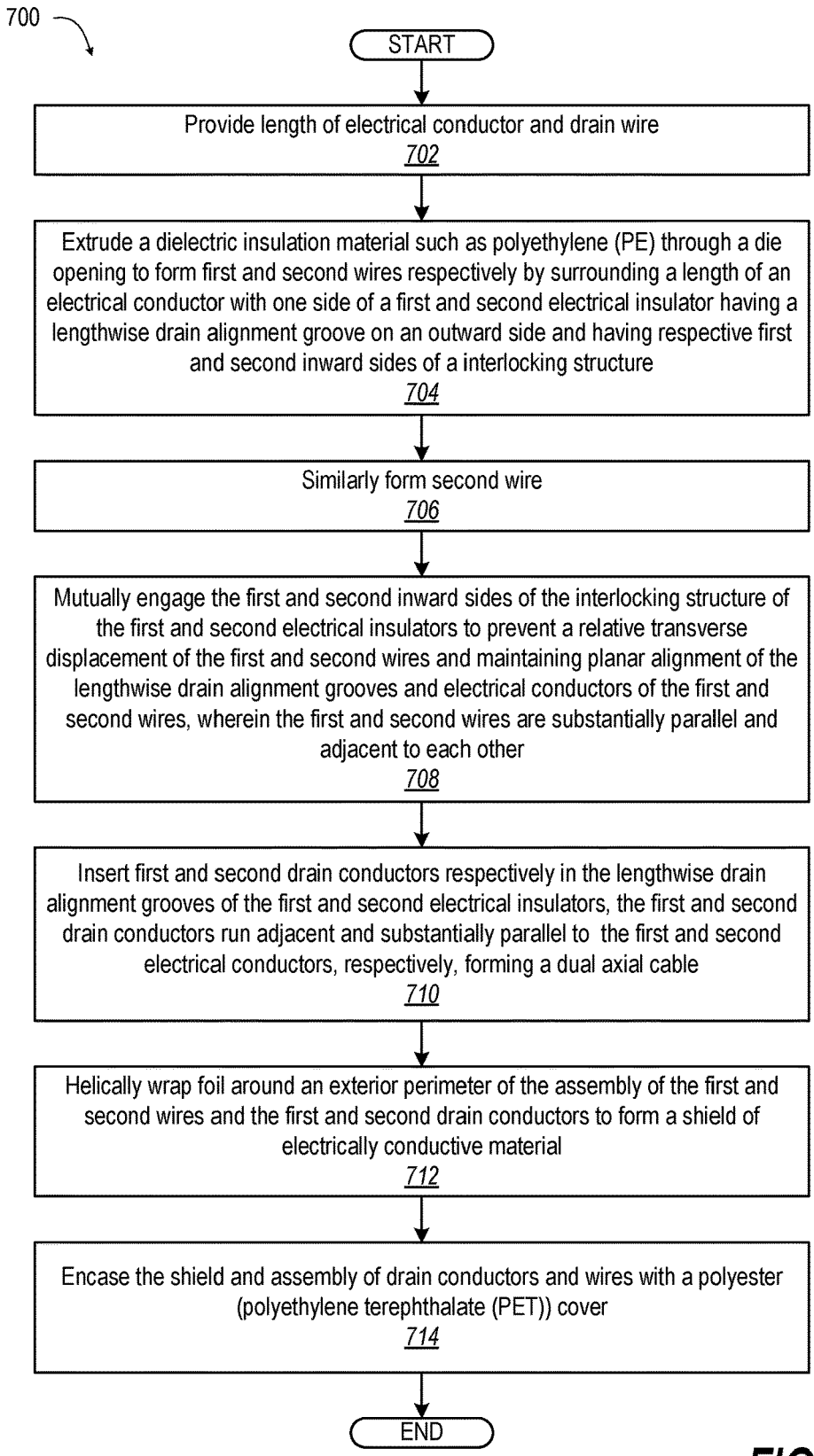
FIG. 7 is a flow diagram illustrating a method of making a dual-drain, dual axial cable that maintains planar alignment during shield wrapping to ensure high communication performance, according to one or more embodiments.

FIG. 7 is a flow diagram illustrating a method 700 of making a dual-drain, dual axial cable that maintains planar alignment during shield wrapping to ensure high communication performance. Method 700 begins at block 702 and includes providing lengths of electrical conductor and drain wire (block 702). Method 700 includes extruding a dielectric insulation material, such as polyethylene (PE), through a die opening to form first wire of PE each surrounding a length of an electrical conductor. Each die imparts a selected one of a first or second electrical insulator with a lengthwise drain alignment groove on an outward side and one side of first or second inward sides of an interlocking structure (block 704). Method 700 includes similarly forming the second wire (method 706). Method 700 includes mutually engaging the first and second inward sides of the interlocking structure of the first and second electrical insulators to prevent a relative transverse displacement of the first and second wires (block 708). Engaging the interlocking structure maintains planar alignment of the lengthwise drain alignment grooves and electrical conductors of the first and second wires. The first and second wires are adjacent and substantially parallel to each other.

In one or more embodiments, the first and second inward sides of the interlocking structure of the first and second electrical insulators comprise corresponding male and female interlocking surfaces. In one or more embodiments, the first and second electrical insulators are identical with the first and second inward sides of the interlocking structure comprising symmetric male and female features.

Method 700 includes inserting first and second drain conductors respectively in the lengthwise drain alignment grooves of the first and second electrical insulators (block 710). The first and second drain conductors run adjacent and substantially parallel to the first and second electrical conductors, respectively, forming a dual axial cable. Method 700 includes helically wrapping foil around an exterior perimeter of the assembly of the first and second wires and the first and second drain conductors to form a shield of electrically conductive material (block 712). Method 700 includes encasing the shield and assembly of drain conductors and wires with a polyester (polyethylene terephthalate (PET)) cover (block 714). Then method 700 ends.

In one or more embodiments, method 700 includes making another dual axial cable. Method 700 includes attaching the dual axial cable to the other axial cable with a ribbon substrate that maintains planar alignment of the lengthwise drain alignment grooves and electrical conductors of the first and second wires of the dual axial cables.

In the above described flow chart of FIG. 7, one or more of the methods may be embodied in an automated manufacturing controller that performs a series of functional processes. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

One or more of the embodiments of the disclosure described can be implemented, at least in part, using a software-controlled programmable processing device, such as a microprocessor, digital signal processor or other processing device, data processing apparatus or system. Thus, it is appreciated that a computer program for configuring a programmable device, apparatus or system to implement the foregoing described methods is envisaged as an aspect of the present disclosure. The computer program may be embodied as source code or undergo compilation for implementation on a processing device, apparatus, or system. Suitably, the computer program is stored on a carrier device in machine or device readable form, for example in solid-state memory, magnetic memory such as disk or tape, optically or magneto-optically readable memory such as compact disk or digital versatile disk, flash memory, etc. The processing device, apparatus or system utilizes the program or a part thereof to configure the processing device, apparatus, or system for operation.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof.

Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A dual axial cable comprising:

adjacent and substantially parallel first and second wires, each wire formed as an electrical conductor surrounded by a respective first and second electrical insulator, the respective first and second electrical insulator each having a lengthwise drain alignment groove on an outward side and having respective first and second inward sides of an interlocking structure, the first and second inward sides of the interlocking structure of the first and second electrical insulators mutually engaged to prevent a relative transverse displacement of both the first and second wires and to maintain planar alignment of the lengthwise drain alignment grooves and electrical conductors of the first and second wires; and first and second drain conductors received respectively in the lengthwise drain alignment grooves of the first and second electrical insulators and running adjacent and substantially parallel to the first and second electrical conductors.

2. The dual axial cable of claim 1, wherein the first and second inward sides of the interlocking structure of the first and second electrical insulators comprise corresponding male and female interlocking surfaces.

3. The dual axial cable of claim 1, wherein the first and second electrical insulators are identical, with the first and second inward sides of the interlocking structure comprising symmetric male and female features.

4. The dual axial cable of claim 1, further comprising a shield of electrically conductive material surrounding an assembly of the first and second wires and the first and second drain conductors.

5. The dual axial cable of claim 4, wherein the shield comprises foil helically wrapped around an exterior perimeter of the assembly the first and second wires and the first and second drain conductors.

6. An information handling system (IHS), comprising:

first and second functional components; and a communication interconnect attached between the first and second functional components and comprising a dual axial cable comprising:

adjacent and substantially parallel first and second wires, each wire formed from an electrical conductor surrounded by a respective first and second electrical insulators having a lengthwise drain alignment groove on an outward side and having respective first and second inward sides of an interlocking structure, the first and second inward sides of the interlocking structure of the first and second electrical insulators mutually engage to prevent a relative transverse displacement of the first and second wires and maintaining planar alignment of the lengthwise drain alignment grooves and electrical conductors of the first and second wires; and first and second drain conductors received respectively in the lengthwise drain alignment grooves of the first and second electrical insulators and run adjacent and substantially parallel to the first and second electrical conductors.

7. The IHS of claim 6, wherein first and second inward sides of the interlocking structure of the first and second electrical insulators comprise corresponding male and female interlocking surfaces.

8. The IHS of claim 6, wherein the first and second electrical insulators are identical with the first and second inward sides of the interlocking structure comprising symmetric male and female features.

9. The IHS of claim 6, further comprising a shield of electrically conductive material surrounding an assembly of the first and second wires and the first and second drain conductors.

10. The IHS of claim 9, wherein the shield comprises foil helically wrapped around an exterior perimeter of the assembly the first and second wires and the first and second drain conductors.

11. The IHS of claim 6, further comprising a ribbon cable comprising:

the dual axial cables;

another dual axial cable; and a ribbon substrate attaching the dual axial cable and the other dual axial cable and maintaining planar alignment of the lengthwise drain alignment grooves and electrical conductors of the first and second wires of the dual axial cables.

12. A method comprising:

forming first and second wires respectively by surrounding a length of an electrical conductor with a respective one of a first and second electrical insulator having a lengthwise drain alignment groove on an outward side and having respective first and second inward sides of an interlocking structure;

mutually engaging the first and second inward sides of the interlocking structure of the first and second electrical insulators to prevent a relative transverse displacement of the first and second wires and maintaining planar alignment of the lengthwise drain alignment grooves and electrical conductors of the first and second wires, wherein the first and second wires are adjacent and substantially parallel to each other; and inserting first and second drain conductors respectively in the lengthwise drain alignment grooves of the first and second electrical insulators, the first and second drain conductors run adjacent and substantially parallel to the first and second electrical conductors, respectively, forming a dual axial cable.

13. The method of claim 12, wherein the first and second inward sides of the interlocking structure of the first and second electrical insulators comprise corresponding male and female interlocking surfaces.

14. The method of claim 12, wherein the first and second electrical insulators are identical with the first and second inward sides of the interlocking structure comprising symmetric male and female features.

15. The method of claim 12, further comprising surrounding an assembly of the first and second wires and the first and second drain conductors with a shield of electrically conductive material.

16. The method of claim 15, wherein surrounding the first and second wires and the first and second drain conductors with the shield of electrically conductive material comprises helically wrapping foil around an exterior perimeter of the assembly of the first and second wires and the first and second drain conductors.

17. The method of claim 12, further comprising:

making another dual axial cable; and attaching the dual axial cable to the other axial cable with a ribbon substrate that maintains planar alignment of the lengthwise drain alignment grooves and electrical conductors of the first and second wires of the dual axial cables.

18. The method of claim 12, wherein surrounding the length of the electrical conductor with the electrical insulator comprises extruding a dielectric insulation material through a die opening that imparts the outer drain alignment groove and one inward side of the interlocking structure.

* * * * *